US010788280B2

(12) United States Patent
Russell

(10) Patent No.: US 10,788,280 B2
(45) Date of Patent: Sep. 29, 2020

(54) MAGAZINE FOLLOWER

(71) Applicant: Okay Industries, Inc., New Britain, CT (US)

(72) Inventor: Shawn H. Russell, Bristol, CT (US)

(73) Assignee: Okay Industries, Inc., New Britain, CT (US)

( * ) Notice: Subject to any disclaimer, the term of this patent is extended or adjusted under 35 U.S.C. 154(b) by 180 days.

(21) Appl. No.: 15/949,164

(22) Filed: Apr. 10, 2018

(65) Prior Publication Data

US 2018/0306539 A1 Oct. 25, 2018

Related U.S. Application Data

(60) Provisional application No. 62/488,308, filed on Apr. 21, 2017.

(51) Int. Cl.
*F41A 9/70* (2006.01)
*F41A 9/65* (2006.01)

(52) U.S. Cl.
CPC . *F41A 9/70* (2013.01); *F41A 9/65* (2013.01)

(58) Field of Classification Search
CPC ..... F41A 9/65; F41A 9/67; F41A 9/70
See application file for complete search history.

(56) References Cited

U.S. PATENT DOCUMENTS 9,945,628 B2 * 4/2018 Kielsmeier ..... F41A 9/70
10,060,691 B2 * 8/2018 Kunz ..... F41A 9/70
2015/0121736 A1 * 5/2015 Faifer ..... F41A 9/65
42/49.01

FOREIGN PATENT DOCUMENTS

CA 2894355 A1 * 7/2016 ..... F41A 9/71

* cited by examiner

*Primary Examiner* — Stephen Johnson
(74) *Attorney, Agent, or Firm* — Alix, Yale & Ristas, LLP

(57) ABSTRACT

A follower for an ammunition magazine comprises an elongated platform which has a spring anchor extending from an underside surface of the platform. The spring anchor comprises a hook-like appendage which defines a central transverse slot which leads to a catch portion from a restricted access portion. An opening is defined in the platform in general longitudinal alignment with a portion of the spring anchor. The follower spring has a mounting end portion. The follower spring passes through the access slot and is received in the catch for assembly to the platform.

18 Claims, 12 Drawing Sheets

MAGAZINE FOLLOWER

CROSS-REFERENCE TO RELATED APPLICATION

This application claims the priority of U.S. Provisional Patent Application No. 62/488,308 filed on Apr. 21, 2017, the entirety of which application is incorporated herein by reference.

BACKGROUND

This disclosure relates generally to firearm magazines. More particularly, this disclosure relates to followers and methods for assembling followers for multi-cartridge firearm magazines.

Cartridge ammunition magazines of various forms have been proposed and various improvements have been disclosed in numerous patents. All such related magazines employ a follower which is spring-loaded. When ammunition is loaded into the magazine, the follower is forced toward the opposite end away from the feed end of the magazine. The spring, which engages the follower, is compressed by the received ammunition. The spring urges the follower toward the feed end of the magazine to force the ammunition toward the feed end of the magazine and ultimate ejection from the magazine for firing. The follower continuously pushes the succeeding ammunition toward the feed end to present a cartridge for the next round.

The ammunition magazine typically has an elongated case which may be slightly rounded and includes a top assembly defining an opening at the feed end and a bottom plate assembly. The follower is inserted into the cartridge and engaged with a spring which typically has a quasi-rectangular coiled form that somewhat mirrors the adjacent interior walls of the magazine casing. The spring has an upper free end is engaged with the underside of the follower.

In the conventional assembly method and process to which the present disclosure relates, the free end of the spring has a distal end portion that is inserted through an eyehole or a circular opening which integrally extends from an appendage at the underside of the follower. The conventional assembly thus requires, inter alia, that the assembler locate the opening, align the free end of the spring, and insert same through the opening, and then insert the assembled follower and spring into the magazine.

The magazine follower is typically a molded member of one-piece integral form dimensioned and configured for efficient and reliable sliding operation during its operation with the associated firearm. The follower generally is a molded plastic member having multiple intersecting planar and non-planar surfaces with various oblique intersections and multiple recesses, and typically is manufactured in a molding process which is not without significant complexity.

The magazine follower as disclosed herein is configured to provide an efficient form which improves the efficiency and ultimately reduces the cost of the magazine assembly process while also lending itself to an efficient molding process for the follower.

SUMMARY

Briefly stated, a follower for an ammunition magazine comprises an elongated platform. The platform has a first surface and an opposite second surface and longitudinally spaced ends. A side extends downwardly from each said end.

A spring anchor extends from the second surface and comprises a hook-like appendage. The appendage defines a generally central transverse slot with a catch portion and a restricted generally longitudinally extending access portion. An opening is defined in the platform and traverses through the platform in general alignment with the portion of the spring anchor.

The catch portion preferably has a round or arcuate shape. In some embodiments, the catch portion has a V-shape, a truncated rectilinear shape or a faceted shape. Portions surrounding the platform opening are faceted. The platform opening preferably has a longitudinal dimension which is greater than that of the catch portion and the access portion. The catch portion is substantially equidistantly spaced from the sides. The follower is preferably a one-piece molded member. The appendage has a longitudinal dimension of approximately 0.30 inches with an access portion spaced approximately 0.095 inches from the second surface. The access portion defines an access opening preferably having a beveled entry portion.

A follower for an ammunition magazine comprises an elongated platform having a first surface and an opposite second surface. The platform has longitudinally spaced ends with a side member extending from each end. A spring anchor extends from the second surface and comprises a hook-like appendage. The appendage defines a generally central transverse slot with a catch portion and a restricted generally longitudinally extending access portion.

In one embodiment, the catch portion has an arcuate round shape. The catch portion may also have a V-shape, a truncated rectilinear shape or a faceted shape. The catch portion preferably defines a shape having a maximum distance from the second surface which is greater than a spacing of the restricted generally longitudinally extended access portion. The access portion preferably has a beveled entry portion.

A method of assembling an ammunition magazine comprises providing a follower having an elongated platform with an underside and an anchor mount integrally extending at the underside with a catch portion and a longitudinally extending access slot. A spring has a mounting end portion. The method comprises positioning the spring mounting end portion adjacent to or against the underside and relatively moving the mounting end portion through the access slot and receiving the mounting end portion in the catch. The method also comprises providing a magazine case and inserting the follower and spring into the case.

DETAILED DESCRIPTION

Figure 1:
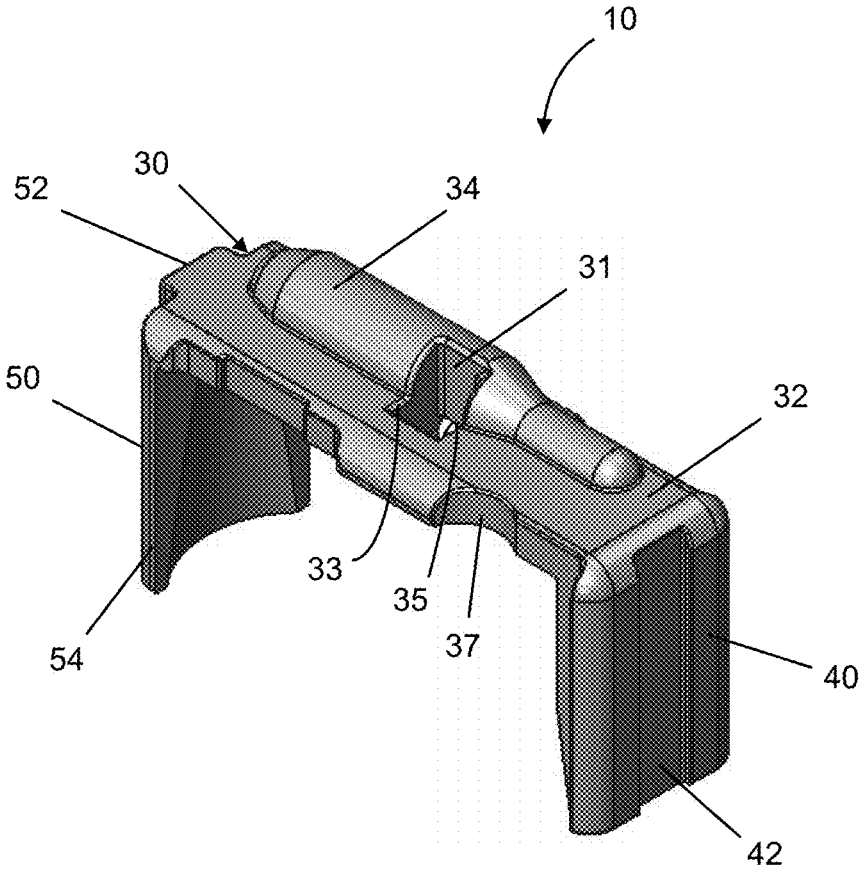
FIG. 1 is a perspective view of a magazine follower.

With reference to the drawings wherein like numerals represent like parts throughout the several figures, a magazine follower is generally designated by the numeral 10. The follower 10 is preferably a one-piece molded member. The follower 10 is configured and dimensioned for supporting a stack of cartridges (not illustrated) in a magazine and facilitating ejection of the cartridges from the magazine. A spring 12 engages the underside of the follower and biases same toward the upper ejection end of the magazine.

The magazine follower 10 may have numerous forms and configurations as well as dimensions. Dimensions for one embodiment only are set forth in some of the drawings. It should be appreciated that numerous other embodiments of a follower for which the spring anchor may have applicability are quite possible.

The magazine follower incorporates a spring anchor 20 which is adapted to facilitate the mounting of a spring 12 to the follower prior to insertion of the follower/spring assembly into the magazine case (not illustrated) during the magazine assembly process.

The follower 10 includes a platform 30 having an upper surface 32 with a raised silhouette portion 34 which allows for the cartridges to be loaded in a pair of slightly offset stacks within the magazine. The platform 30 has an underside 36 which integrally mounts the spring anchor 20 at a central location.

The follower 10 includes a forward guide side 40 and a rear guide side 50 which each extend vertically downwardly from the platform 30. The forward guide side 40 preferably has a shallow recess 42 which receives a shallow tine (not illustrated) at the interior of the magazine. The rear side 50 includes an integral tine 52 which engages in a corresponding guide slot (not illustrated) at the rear side of the magazine. Arms 54 and 56 project forwardly at opposed rear side locations of the platform 30 and extend down the rear side to facilitate the smooth displacement of the platform as the cartridges are ejected from the magazine. The platform 30 also includes laterally spaced frontal recesses 37 and 39. All of the structures that extend below the platform 30 function to facilitate the displacement of the follower in the magazine and/or provide a guide for the spring as the cartridges are ejected.

Figure 2:
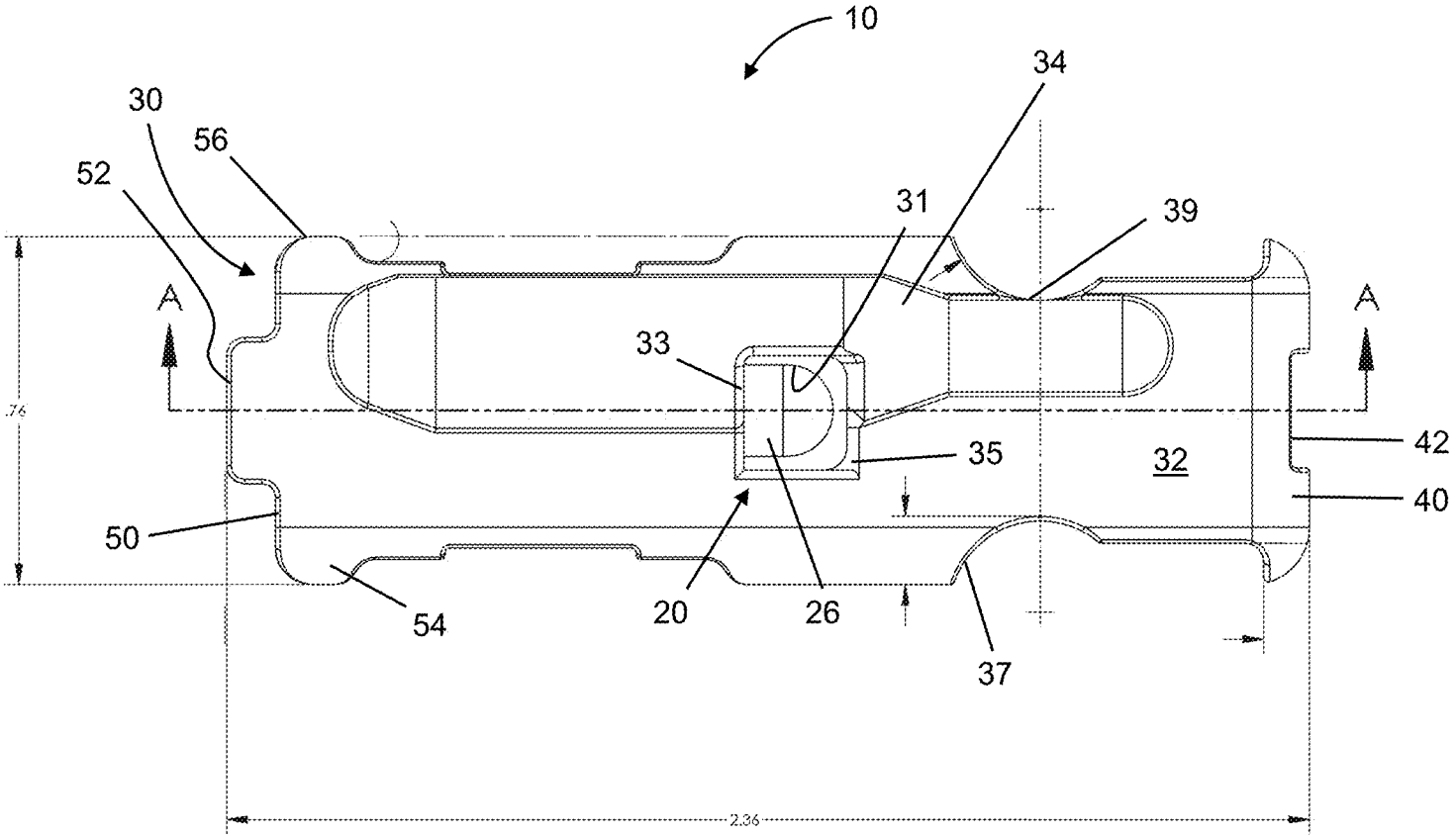
FIG. 2 is a diagrammatic top plan view of the follower of FIG. 1.

In the disclosed embodiment (FIGS. 2-4), the platform 30 has a maximum length L of 2.36 inches and a maximum width W of 0.76 inches. The guide sides 40, 50 extend from the underside 36 of the platform a distance H of approximately 0.98 inches. The platform thickness T is approximately 0.15 inches.

Figure 3:
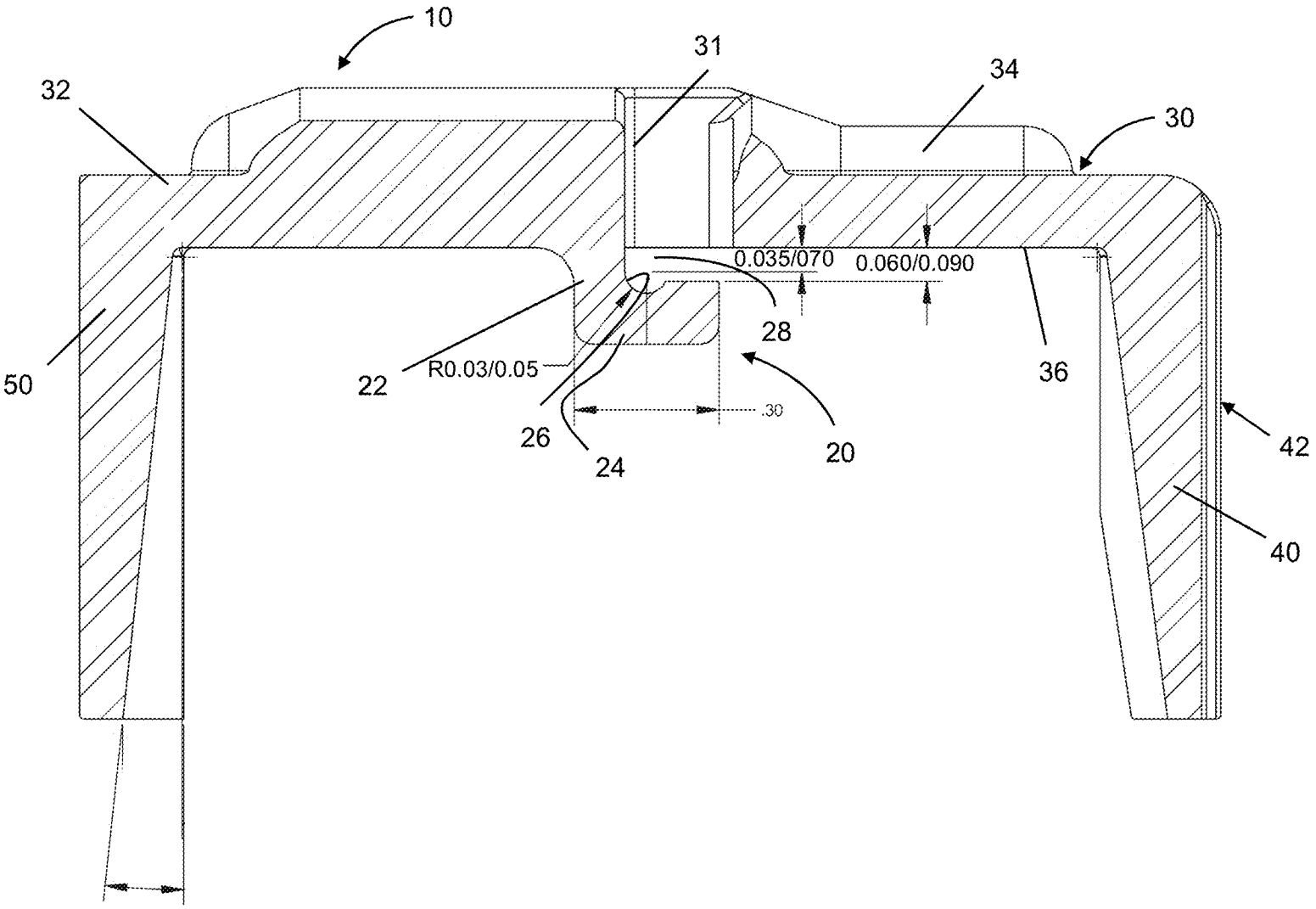
FIG. 3 is a diagrammatic sectional view of the follower of FIG. 2 taken along the line A-A thereof.
Figure 4:
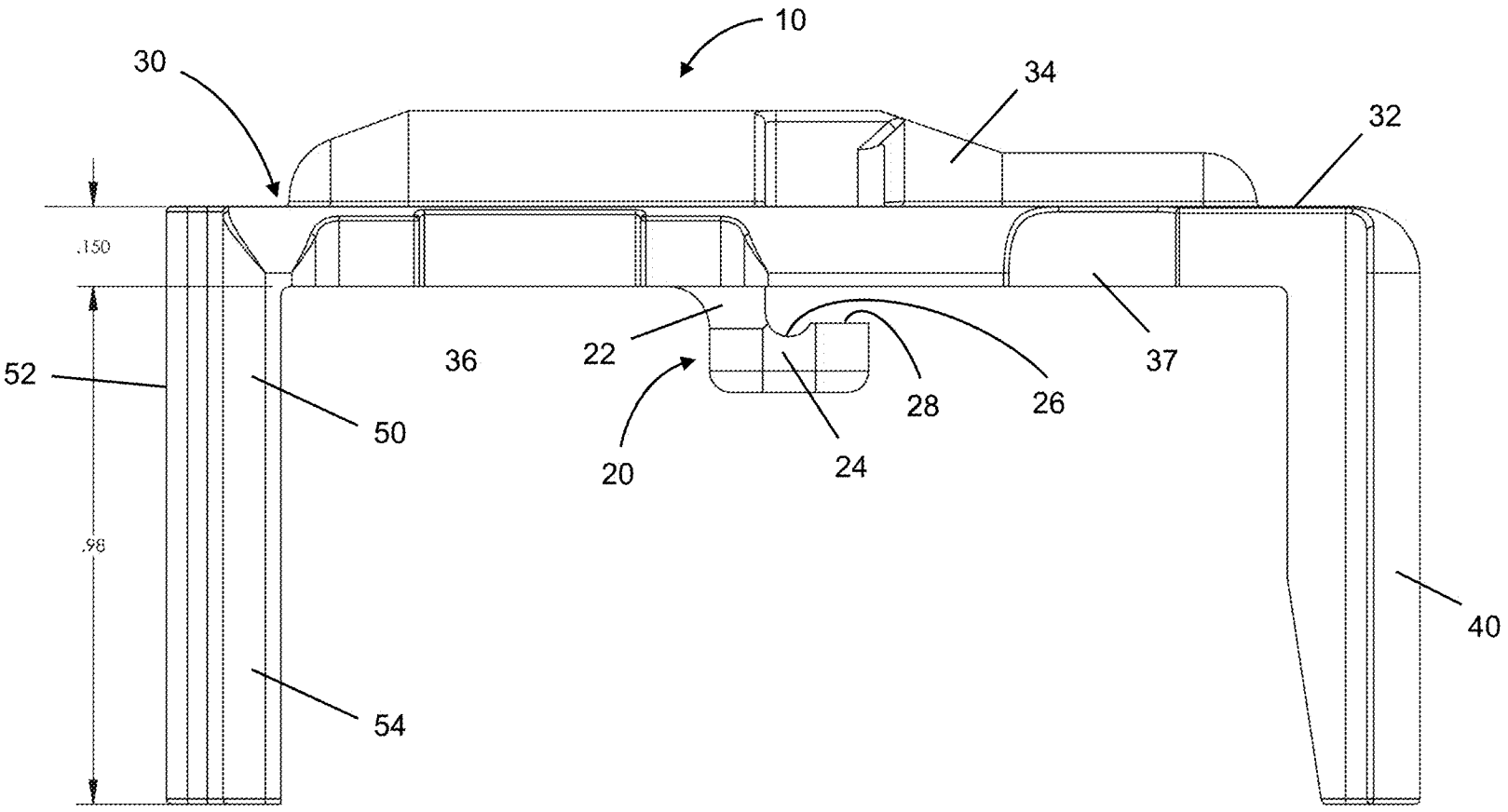
FIG. 4 is a diagrammatic front elevational view of the follower of FIG. 1.

With additional reference to FIGS. 3 and 4, the spring anchor 20 integrally extends from the underside 36 of the platform. The spring anchor 20 is generally centrally located at the central portion of the follower and has a unitary structure. The spring anchor includes a connector 22 which mounts a quasi-hook-like retainer 24 having a recessed catch 26 and a longitudinal access slot 28 to the catch defined at the underside of the platform. The catch 26 preferably has an arcuate recess with a radius R which ranges between 0.035 and 0.060 inches with a center spaced from the underside 36 a distance d of between 0.060 and 0.090 inches.

Figure 4A:
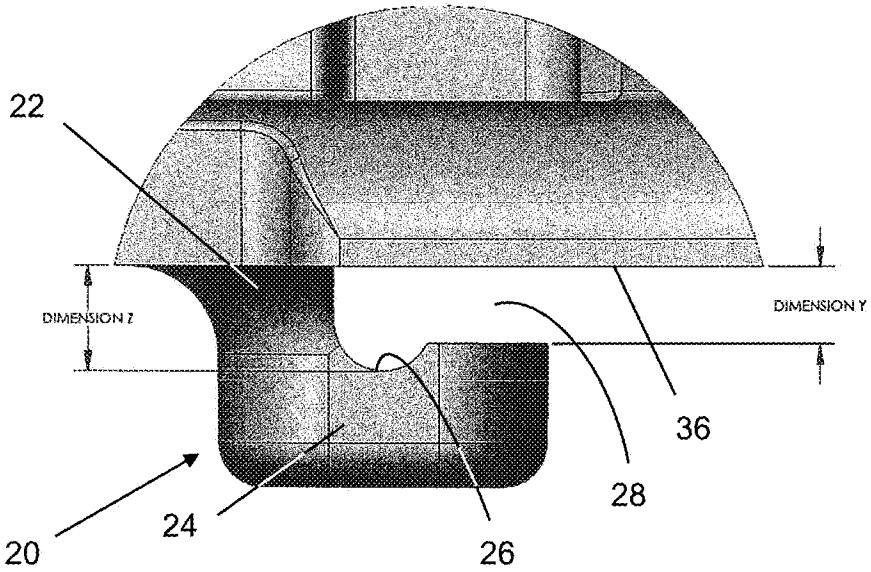
FIG. 4A is a diagrammatic enlarged fragmentary front view of the follower of FIG. 4.
Figure 5:
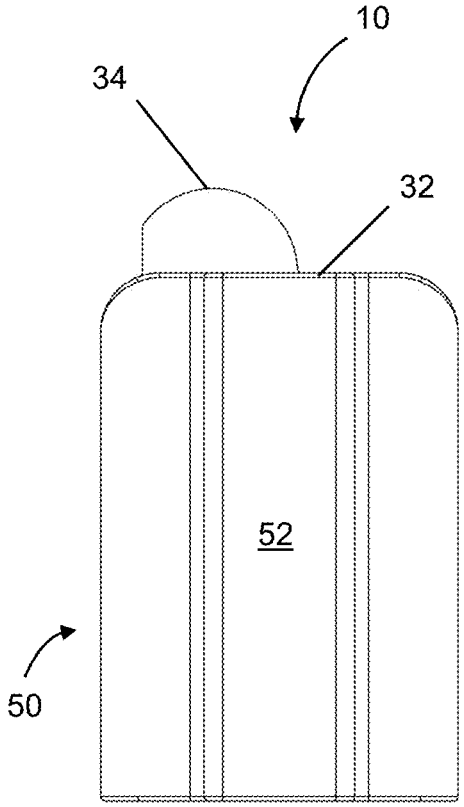
FIG. 5 is a left side elevational view of the follower of FIG. 1.
Figure 6:
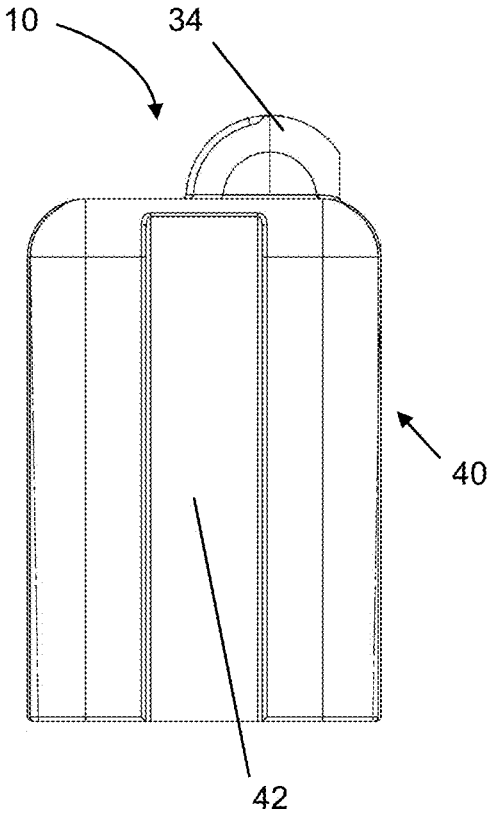
FIG. 6 is a diagrammatic right side elevational view of the follower of FIG. 4.
Figure 7:
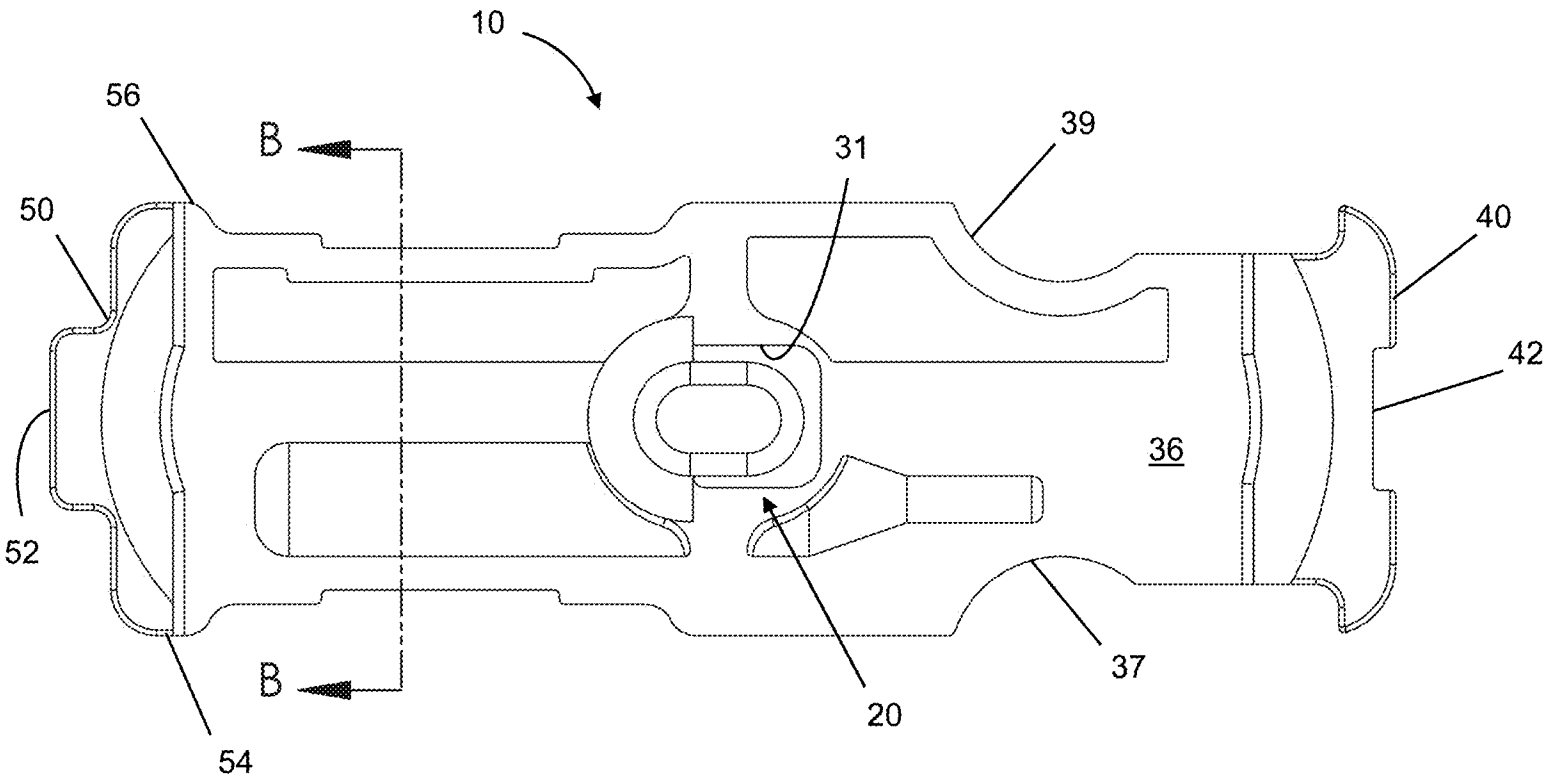
FIG. 7 is a diagrammatic bottom plan view of the follower of FIG. 1.
Figure 8:
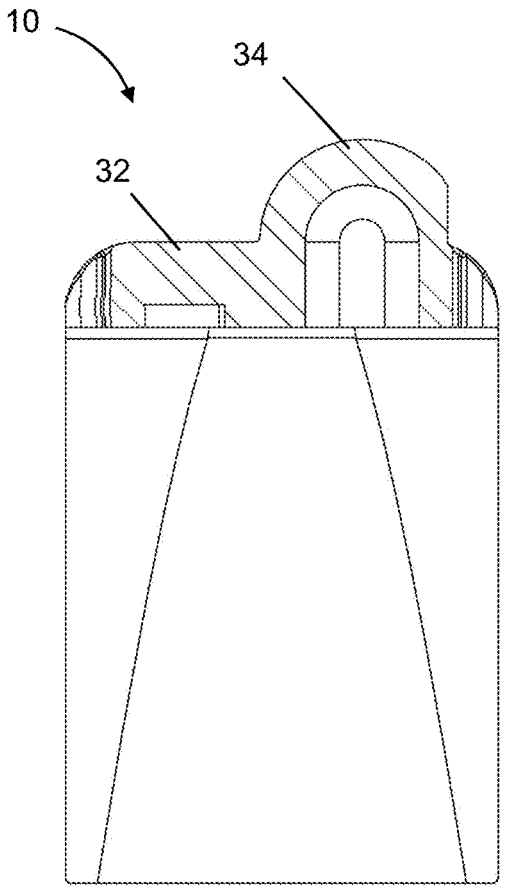
FIG. 8 is a sectional view of the follower of FIG. 7 taken along the line B-B thereof.

As best illustrated in FIG. 4A, dimension Y is a smaller value than dimension Z. The spacing defined by dimension Y allows the spring to pass between the underside of the platform and the bottom of the access opening 28 so that the free end portion of the spring is received in the catch 26. In one embodiment, Y is approximately 0.07 inches and Z is approximately 0.095 inches. The longitudinal length l of retainer 24 is (FIG. 3) approximately 0.30 inches. Other dimensions are possible.

Figure 9A:
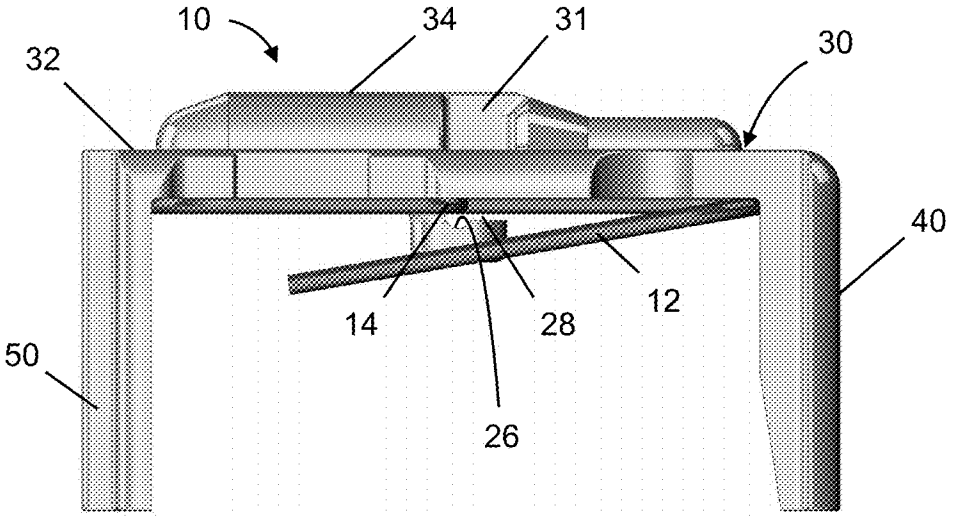
FIGS. 9A-9B are respectively a front view and a rear perspective view, each being a partial assembly view illustrating a portion of a follower spring and the follower of FIG. 1.
Figure 9B:
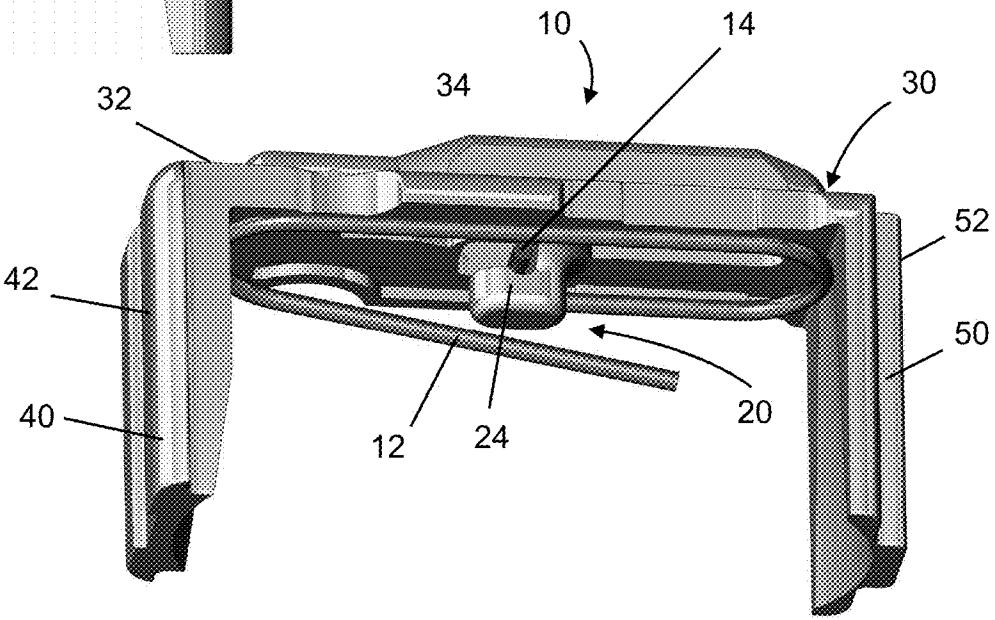
Figure 10:
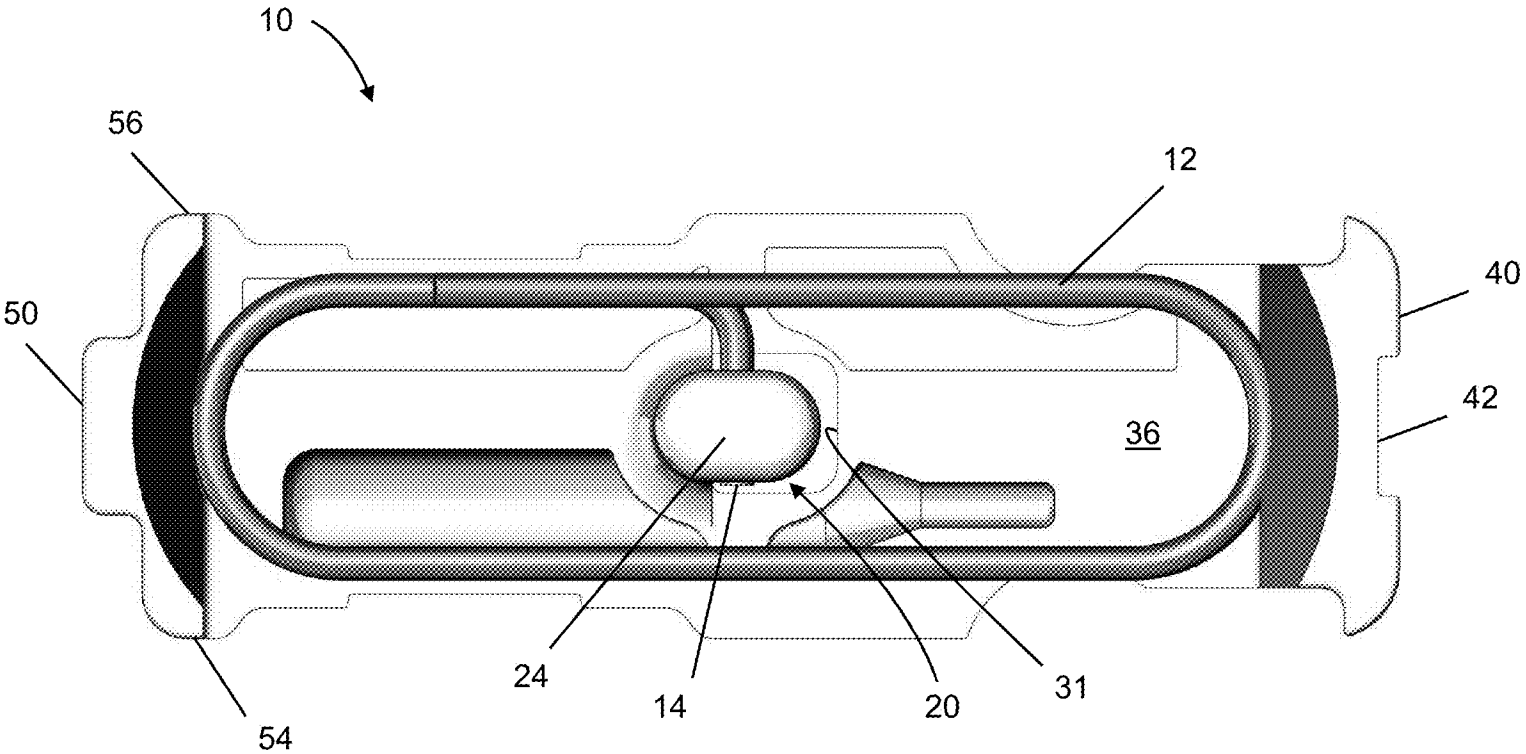
FIG. 10 is a bottom plan view of the assembled follower spring and follower of FIGS. 9A-9B.
Figure 11A:
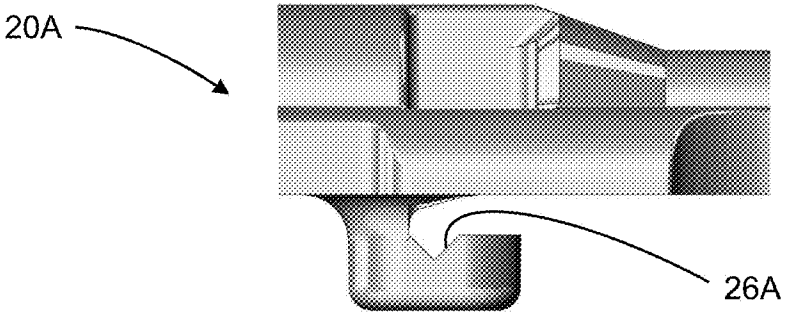
FIGS. 11A-11C are respectively enlarged fragmentary front perspective views illustrating various alternative embodiments for the spring anchor mount of the follower of FIG. 1.
Figure 11B:
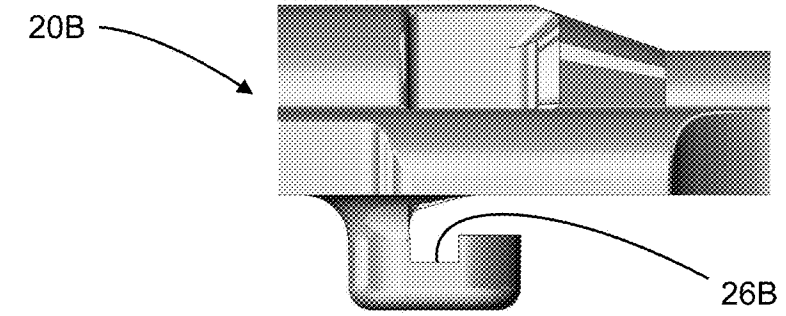
Figure 11C:
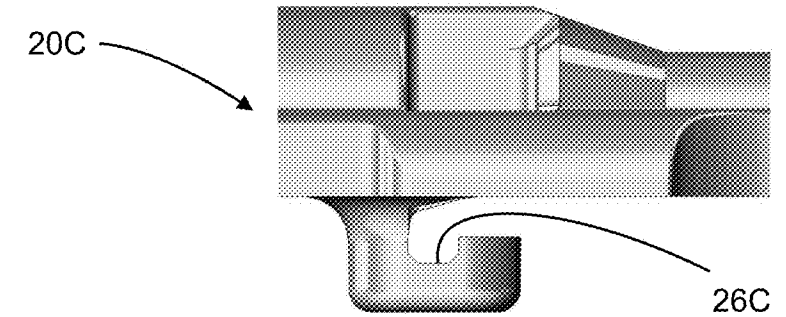

As illustrated in FIGS. 9A and 9B, the spring 12 engages the underside of the platform and the free end 14 of the spring slides through the access slot 28 upon pivoting the spring until the free end is received in the catch 26. It will be appreciated that the spring anchor 20 has a quasi-resilient structure that will allow the spring wire to pass through the access slot for capture in the catch. Once the spring is snapped into an installed position (FIG. 10), it is secured to the follower. The spring/follower subassembly is then inserted into the magazine box.

It will be appreciated that an opening 31 is formed in a central portion of the platform and disposed above the spring anchor 20. The opening preferably has chamfered opposed upper access surfaces 33 and 35 leading into the opening. The opening 31 facilitates and enhances the follower molding process.

The spring anchor 20 represents a structure which facilitates the assembly of the spring 12 to the follower 10. In a conventional assembly process, a circular opening is provided below the platform. It is necessary to align the free mounting end of the spring with the opening and insert the free end through the hole. By contrast, the spring anchor 20 cooperates with the underside of the platform to facilitate the reception of the spring into the catch by a simple twist or pivot of the spring.

With reference to FIGS. 10A-10C, alternate embodiments of the catch 20A, 20B and 20C are provided. Spring anchor 20A has a catch 26A with a V-shaped configuration. Spring anchor 20 has a catch 26B with a truncated rectilinear configuration. Spring anchor 20C has a catch 26C with a faceted configuration. Other configurations are also possible.

Figure 12:
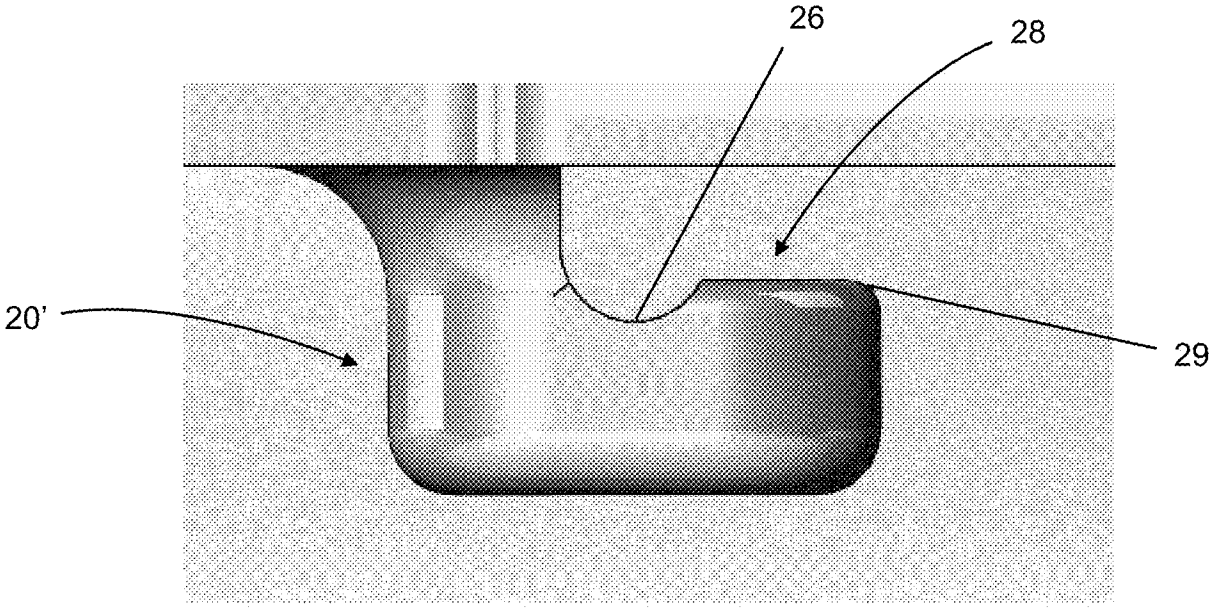
FIG. 12 is an enlarged fragmentary front perspective view illustrating a modified embodiment for the spring anchor mount of FIG. 4A.

With reference to FIG. 12, spring anchor 20' is a modified embodiment of spring anchor 20 best illustrated in FIG. 4A wherein a rounded or beveled surface 29 is formed at the entry to the access slot 28 to facilitate reception of the spring by the spring anchor into the access slot 28 and eventually into the recessed catch 26.

While preferred embodiments of the foregoing have been set forth for purposes of illustration, the foregoing description should not be deemed a limitation of the invention herein. Accordingly, various modifications, adaptations and alternatives may occur to one skilled in the art without departing from the spirit and the scope of the present invention.

The invention claimed is:

1. A follower for an ammunition magazine comprising:

an elongated platform having a first surface and an opposite second surface and having longitudinally spaced ends with a side extending from each said end and having a front and a transversely spaced rear;

a spring anchor extending from said second surface and comprising a hook-like appendage defining a transverse slot with a longitudinally central catch portion and a restricted generally longitudinally extending access portion partially defined by a surface spaced from said second surface; and an opening defined in said platform and traversing therethrough in general alignment with a portion of said spring anchor.

2. The follower of claim 1 wherein said catch portion has a round shape.

3. The follower of claim 1 wherein said catch portion has a V-shape.

4. The follower of claim 1 wherein said catch portion has a truncated rectilinear shape.

5. The follower of claim 1 wherein said catch portion has a faceted shape.

6. The follower of claim 1 wherein portions surrounding said opening are beveled.

7. The follower of claim 1 wherein said opening has a longitudinal dimension which is greater than that of said catch portion and said access portion.

8. The follower of claim 1 wherein said catch portion is substantially equidistantly spaced from said sides.

9. The follower of claim 1 wherein said follower is a one-piece molded member.

10. The follower of claim 1 wherein said appendage has a longitudinal dimension of approximately 0.30 inches with an access portion surface spaced 0.095 inches from the second surface.

11. The follower of claim 1 wherein the access portion defines an access opening having a beveled entry portion.

12. A follower for an ammunition magazine comprising:

an elongated platform having a first surface and an opposite second surface and having longitudinally spaced ends with a side member extending from each said end and having a front and a transversely spaced rear; and a spring anchor extending from said second surface and comprising a hook-like appendage defining a transverse slot with a longitudinally central catch portion and a restricted generally longitudinally extending access portion partially defined by a surface spaced from said second surface.

13. The follower of claim 12 wherein said catch portion has an arcuate round shape.

14. The follower of claim 12 wherein said catch portion has a V-shape.

15. The follower of claim 12 wherein said catch portion has a truncated rectilinear shape.

16. The follower of claim 12 wherein said catch portion has a faceted shape.

17. The follower of claim 12 wherein said catch portion defines a shape having a maximum distance from said second surface which is greater than a spacing of the restricted generally longitudinally extending access portion.

18. The follower of claim 12 wherein the access portion has a beveled entry portion.

* * * * *